United States Patent [19]

Hieb et al.

[11] Patent Number: 4,986,615

[45] Date of Patent: Jan. 22, 1991

[54] VENDING APPARATUS

[75] Inventors: Larry E. Hieb, Fresno; Gregory A. Petrie, Madera; Daniel S. Carter, Clovis, all of Calif.

[73] Assignee: The Vendo Company, Fresno, Calif.

[21] Appl. No.: 258,896

[22] Filed: Oct. 17, 1988

[51] Int. Cl.[5] ..... B65D 83/04

[52] U.S. Cl. ..... 312/45; 221/67; 221/241; 211/59.2

[58] Field of Search ..... 211/59.1, 59.2; 221/67, 221/241; 312/42, 45, 72, 73

[56] References Cited

U.S. PATENT DOCUMENTS

| | | | |
|---|---|---|---|
| 2,511,099 | 6/1950 | Case | 211/59.2 |
| 2,799,399 | 7/1957 | Cannon | 312/42 |
| 2,836,326 | 5/1958 | Childers | 221/67 |
| 4,454,961 | 6/1984 | Childers et al. | 211/59.2 |
| 4,598,828 | 2/1986 | Young et al. | 211/59.2 |
| 4,705,176 | 11/1987 | Oden | 211/59.2 |

*Primary Examiner*—Joseph Falk

*Attorney, Agent, or Firm*—Worrel & Worrel

[57] ABSTRACT

A vending apparatus for facilitating passage of a vendable object through a vending machine, the apparatus including a main body borne by the vending machine and mounting a pair of ribs which are disposed in spaced relation one to the other and which are individually adapted to support the vendable object in spaced relation to the main body, the ribs operable substantially to inhibit the vendable objects from bridging with adjoining vendable objects and thereby increasing the reliability of the vending machine so equipped.

5 Claims, 4 Drawing Sheets

VENDING APPARATUS

BACKGROUND OF THE INVENTION

1. Field of the Invention:

The present invention relates to a vending apparatus for facilitating movement of vendable objects along a path of travel and more particularly to an apparatus which is operable to increase the reliability of vending machines that are adapted selectively to vend products such as bottled beverages by substantially inhibiting the tendency of such containers to bridge with adjoining containers during a vending cycle.

2. Description of the Prior Art: The prior art is replete with numerous examples of vending machines, attachments and related assemblies which are operable to dispense or to assist in the dispensing of products from a vending machine. The problem of product bridging is presented in the vending of virtually all products. Bridging occurs when two or more products gravitationally contact one another in the stack in such a way that they cannot move therebeyond. This prevents any further products from being vended therefrom.

The problem of product bridging is particularly acute in the vending of glass bottles where, for example, the bottles may be of unusual shapes and sizes and/or have external ribs which contribute to bridging. In any case, such bottles typically have narrow neck portions, wide central or shoulder portions and wide base or butt portions. Such product configurations greatly aggravate the problem of product bridging.

A wide variety of vending machines and attachments therefor have been developed to vend or assist in vending bottled products. For example, bottled products are vended by so-called staggered stack type vending machines. In a staggered stack vending machine, the bottles are stored on their sides in a horizontally overlapping or offset relation relative to adjoining bottles which are disposed in both upstream and downstream relation thereto. The bottles are received within substantially vertically extending magazines or columns from which they are successively released by a dispensing apparatus or other mechanism which is disposed in gravitationally receiving relation at the bottom of the column. It is known to use ramps in such machines to direct the bottles into a single column prior to vending or to direct the bottles from one column to another for certain purposes. The ramps frequently cause product bridging in a "bridge zone" at the point of merging.

In addition, slant shelf-type vending machines have been designed whereby the bottles are stored on their sides in side-by-side laterally rollable relation upon a series of inclined shelves and from which they may successively be longitudinally withdrawn past a lockable gate which is disposed in a position closely adjacent the lower end of each shelf. Product bridging can also occur in vending machines of this type.

While it is well understood that these prior art devices each have their own advantages for particular applications and environments, they suffer, however, from a multiplicity of other drawbacks and shortcomings which have detracted from their usefulness. The problem of product bridging continues to plague the operation of such machines. In addition, manufacturers who produce such machines must manufacture assorted differently designed parts in order to assemble these individual devices with the costs attendant such design and manufacture. Further, the vending machines have individually unique maintenance and supply problems which are peculiar to the individual vending machine under consideration.

Manufacturers of vending machines have endeavored, for some period of time, to develop a vending machine which is adapted to dispense containers of assorted sizes and shapes wherein such variations in the containers to be vended can be accommodated by relatively rapid modification or conversion of the vending machine. Such a machine would thereby be operable to vend varieties of soft drink containers, whether glass bottles or metal cans, to permit vending of all styles of containers. Such prior art attempts have not been commercially successful. While the particular prior art attempts toward achieving this objective have operated with some degree of success, they also have their individual shortcomings. For example, some of these vending machines require rather time consuming modifications in order to be converted into a selected operational configuration which will permit vending of a particular size, type or style of container. In addition, they have proven particularly unreliable in operation, especially when dispensing certain types of containers such as glass bottles of the typical configurations.

Still another significant problem with the prior art devices and practices results from characteristics inherent in their individual designs. Where conversion is required with such machines, they must either be converted at the field location, or returned to the manufacturer for such conversion. Neither approach has proven satisfactory, in the first instance because of the lack of reliability in the conversion and in the second instance because of the expense attendant thereto. Furthermore, they have not generally exhibited satisfactory reliability in relatively unattended field locations. In addition, the initial cost of manufacturing and installing such devices as well as the overall maintenance cost requirements related to these devices may be substantial.

Therefore, it has long been known that it would be desirable to have a vending apparatus which is operable to prevent product bridging and which has particular utility when used in combination with conventionally designed vending machines in the vending of bottled products, the apparatus operable substantially to increase the reliability of such vending machines while simultaneously decreasing the overall maintenance requirements of the vending machine so equipped and permitting the vending machines easily to be modified in such a fashion whereby they can be rendered operable so as reliably to vend containers of assorted styles and dimensions with the attendant benefits to be derived from such modifications.

SUMMARY OF THE INVENTION

Therefore it is an object of the present invention to provide an improved vending apparatus.

Another object is to provide such an apparatus which facilitates the passage of vendable objects through a bridge zone in a vending machine.

Another object is to provide such a vending apparatus which has particular utility in facilitating the movement of vendable objects in gravitational feeding relation in conventional vending machines.

Another object is to provide such a vending apparatus which can be retrofitted with little difficulty to existing vending machines or can alternatively be manufactured as a subassembly thereof.

Another object is to provide such a vending apparatus which is operable in combination with a ramp in a vending machine having staggered stack columns facilitating the movement of bottled products therethrough in such a manner as to prevent bridging.

Another object is to provide such a vending apparatus which permits a vending machine to dispense containers having assorted different shapes and sizes and which permits rapid conversion of the vending machine from vending one type of container to another thereby increasing the versatility of such a vending machine which is so equipped.

Another object is to provide such a vending apparatus which is characterized by simplicity of design, ease of employment, and which can be sold at a relatively nominal price.

Another object is to provide such a vending apparatus which is operable to obtain the individual benefits to be derived from prior art devices employed in vending while avoiding the detriments individually associated therewith.

Another object is to provide such a vending apparatus which, when constructed in a second form, is fully adjustable to adapt to different vending machines and to accommodate different vendables.

Further objects and advantages are to provide improved elements and arrangements thereof in a vending apparatus for the purposes described which is dependable, durable and fully effective in accomplishing its intended purposes.

These and other objects and advantages are achieved in the vending apparatus of the present invention wherein, in the preferred embodiment, the apparatus has a main body releasably borne by the vending machine mounting a pair of members disposed in spaced relation to each other and individually operable to guide a vendable object in spaced relation to the main body so as substantially to inhibit the individual vendable objects from bridging and thereby increasing the reliability of a vending machine so equipped.

DESCRIPTION OF THE PREFERRED EMBODIMENT

First Form

Figure 1:
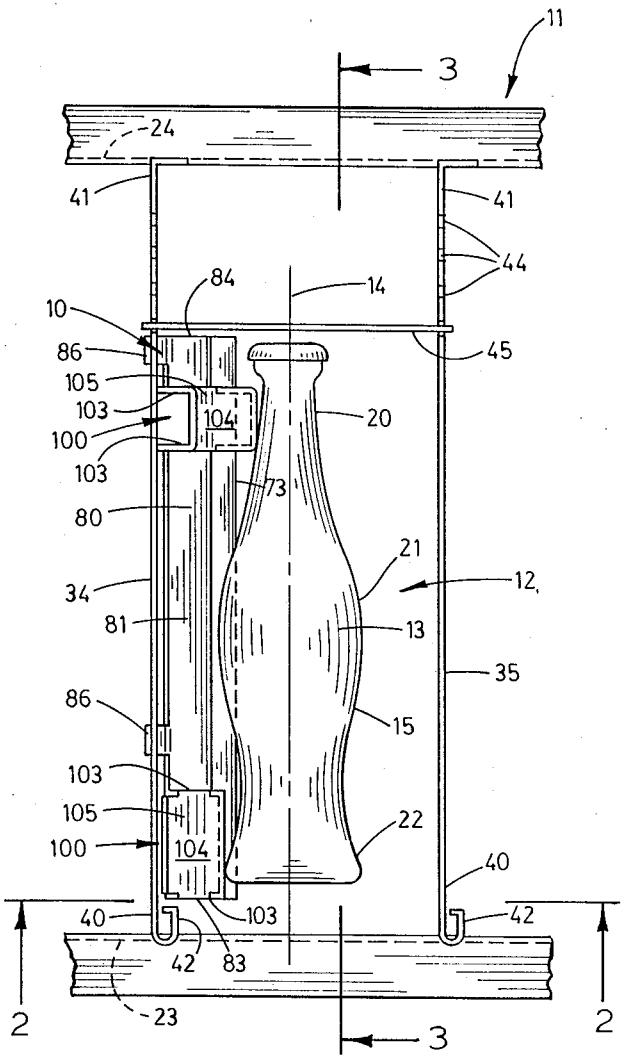
FIG. 1 is an end view of the vending apparatus of the present invention shown in a typical operative configuration mounted on a fragmentarily illustrated vending machine of conventional design.
Figure 2:
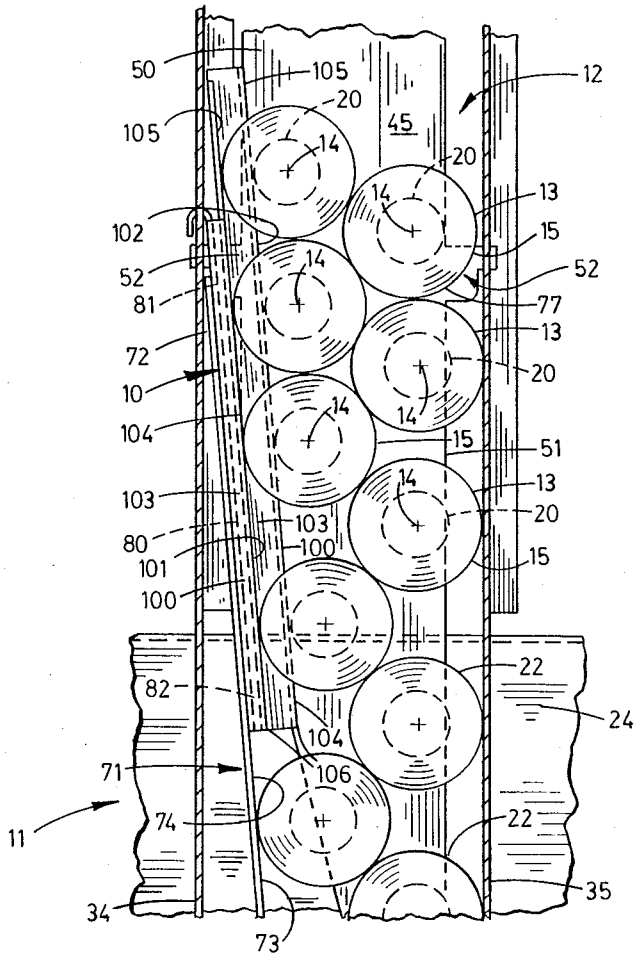
FIG. 2 is a transverse vertical section taken from a position indicated by line 2—2 in FIG. 1 and showing the vending apparatus of the present invention in side elevation.
Figure 3:
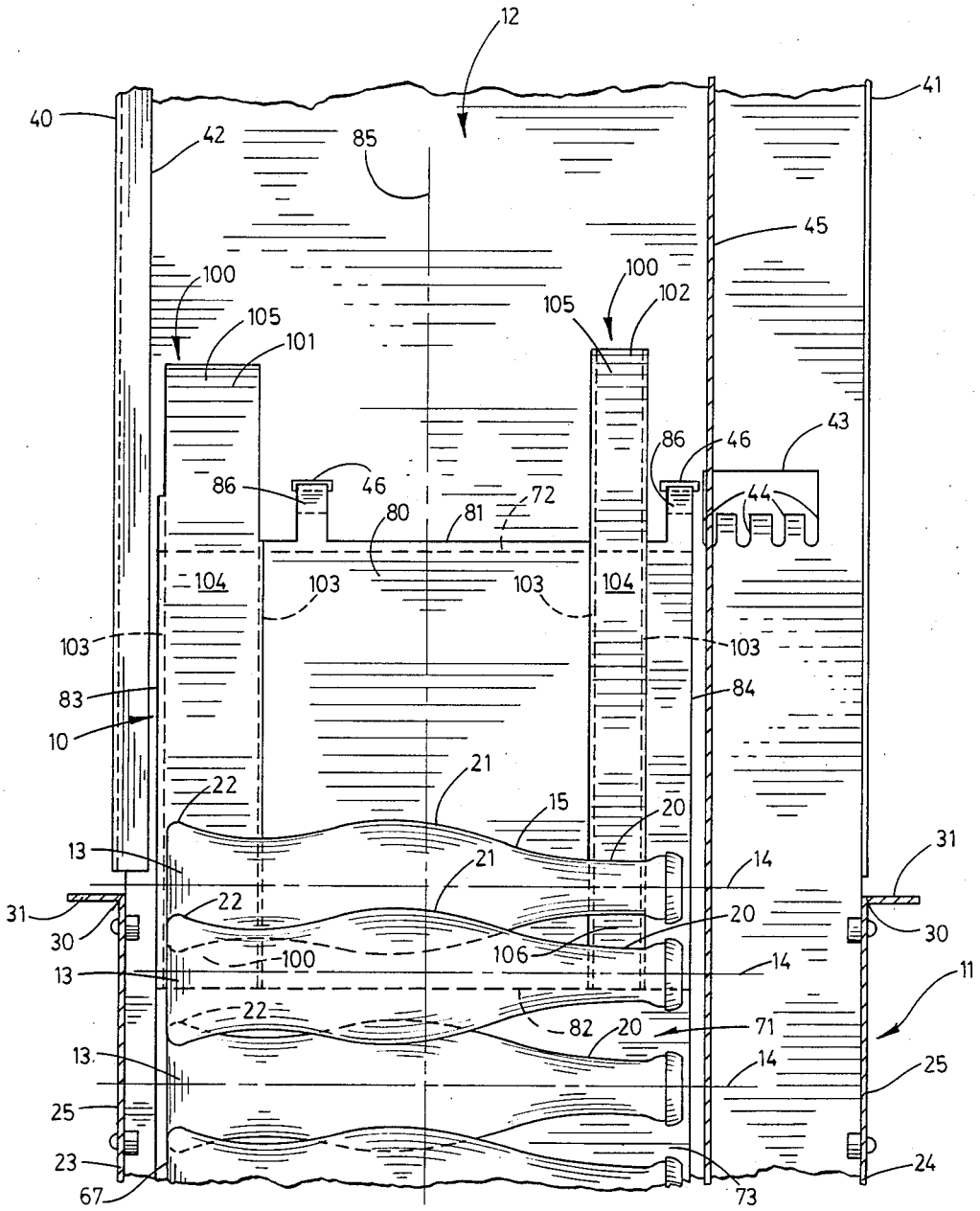
FIG. 3 is a longitudinal, vertical section taken from a position indicated by line 3—3 in FIG. 1 and showing the vending apparatus of the present invention in plan view.

Referring more particularly to the drawings, the vending apparatus of the first form embodying the principles of the present invention is generally indicated by the numeral 10 in FIGS. 1 through 3. For illustrative convenience, the vending apparatus as shown and described herein is discussed as it would be configured if it were manufactured and installed as an operable subassembly on a vending machine 11 which is fragmentarily shown in the drawings. The vending machine itself is otherwise of conventional construction and mounts a plurality of staggered stack vending columns 12, only one of which is shown.

Alternatively, the vending apparatus can be manufactured as a separate component and preexisting vending machines can be modified or otherwise retrofitted so as to employ the vending apparatus in the fashion which will hereinafter be discussed in greater detail.

The vending columns 12 are operable to support a plurality of containers for subsequent selective vending therefrom. The containers shown herein are depicted as bottles 13 which have a predetermined diameter and length. Each of the bottles 13 has a longitudinal axis 14. As shown in the drawings, each of the bottles has an exterior 15 which is a surface of revolution commonly known as having a Coke bottle shape. Thus, the exterior surface of each bottle has a narrow neck portion 20, a larger diameter shoulder portion 21 and a base or butt portion 22 having substantially the same diameter as the shoulder portion. The exterior surface may also have low profile ribs, not shown, extending longitudinally thereof.

Although the bottles 13 will hereinafter, for convenience, be referred to as of the described configuration, it is to be understood that the vending apparatus is not to be limited thereto. The vending apparatus is operable with respect to all containers described by a surface of revolution including bottles having a relatively smaller diameter than the depicted bottles and including containers constructed of glass, plastic or metal.

The vending machine 11 is representative of vending machines in general in which the bottles 13 are stored or otherwise supported in a staggered stack column 12. The vending machine can have a plurality of both the staggered stack column type and/or single stack columns, not shown. The assorted columns permit the internal storage space of the vending machine to be substantially allocated or otherwise divided on the basis of sales information concerning the particular varieties of containers which will be dispensed. The staggered stack column 12 has first and second support members 23 and 24, respectively, which are mounted on the vending machine by welding or other fastening techniques. The first and second support members are disposed in predetermined substantially parallel spaced relation one with the other. Each support member has a substantially vertically disposed wall portion 25 which has a top edge 30. A flange member 31 is individually affixed on each of the individual wall portions at the top edge 30 and extends outwardly at a substantially normal attitude therefrom. As best shown in FIGS. 1 and 3, first and second orifices 32 and 33, respectively, are individually formed in substantially identical positions in the first and second support members and are thereby disposed in registry or substantially coaxial alignment one with the other.

A pair of walls, hereinafter referred to as first and second walls 34 and 35, respectively, are mounted on and otherwise individually interconnect the first and second support members 23 and 24, and are disposed in substantially parallel, spaced relation to each other. Each wall has individual first and second ends 40 and 41, respectively, and each first end has a channeling surface of flange member 42 which is operable to direct the plurality of bottles 13 along the staggered stack column 12. Each wall further has a substantially rectangularly shaped opening 43 formed therein. Each of the openings 43 is disposed in approximately the same position in each wall and the openings are thereby disposed in substantially coaxial alignment one with the other. Further, a plurality of adjustment slots 44 are formed in each wall and extend downwardly from each of the rectangularly shaped openings at a substantially normal attitude. The plurality of slots are disposed in substantially equally spaced relation to each other.

An adjustable partition 45 is detachably mounted on each of the walls 34 and 35, respectively. The partition, which is disposed in a substantially normal attitude with respect to the individual walls, is operable slidably to be received in a selected adjustment slot 44 and thereby interconnect the respective walls. With the partition in place, the staggered stack column 12 has a predetermined length dimension which is somewhat slightly greater than the length of the bottles 13. This is illustrated most clearly in FIG. 3. The partition can be mounted slidably in interfitted receipt in any of the plurality of adjustment slots thereby permitting the staggered stack column to be configured in such a fashion whereby it can vend bottles or other containers of variable length. The first wall 34 further has a pair of narrow rectangular slots 46 formed therein. The operation of the pair of slots 46 will hereinafter be discussed in greater detail. The partition has a main body 50 which is defined by a peripheral edge 51. A pair of support tabs 52 are mounted on the main body and are individually dimensioned to be received in interlocking receipt in the individual adjustment slots 44 as shown best in FIGS. 1 and 3.

A ramp, which is generally indicated by the numeral 71, is mounted on the first wall 34 and has a first end 72 and a supporting surface 74. A bridging zone, where the bottles 13 are most likely to bridge in conventional machines, is indicated at 77. The ramp is generally disposed in converging relation to the second wall 35 in a downward direction. The ramp is operable to cause the staggered stack column of bottles 13 to converge into a single column product row. The single column product row feeds and is acted upon by a dispensing mechanism, not shown. The dispensing mechanism constitutes no part of the present invention and is therefore not shown. However, one such dispensing mechanism is shown in U.S. Letters Pat. No. 4,454,961 to Childers et al.

The vending apparatus 10 has a main body 80 with first and second ends 81 and 82, respectively. The main body has left and right lateral or peripheral edges 83 and 84, respectively. As best shown in FIG. 3, the main body has a substantially square shape, and the left and right peripheral edges are disposed in substantially parallel relation to each other. The main body, in use, is disposed in overlaying relation with respect to the first end 72 of the ramp 71 and is supported by the ramp in angulated spaced relation to the first wall 34 and in downwardly converging relation to the second wall 35. The main body has a longitudinal axis 85, and further mounts at the first end thereof a pair of substantially "J" shaped tabs or wall engagement members 86. The engagement members are individually dimensioned individually to extend through the rectangularly shaped slots 46 thereby to be retained in supported relation on the first wall 34. The engagement members are thus operable releasably to secure the vending apparatus 10 in supported relation on the first wall in the predetermined position with respect to the staggered stack column 12 best shown in FIG. 2.

A pair of members, ridges or ribs, which are generally indicated by the numeral 100, are mounted on the main body 80 and are individual operable to support the bottles 13, and in particular the shoulder portions 21 thereof, in spaced relation to the main body. By thus releasing the shoulder portions 21 of the bottles from contact with any portion of the vending machine, it has been discovered that bridging of the bottles is substantially precluded. As the bottles pass gravitationally along the ramp 71 in the staggered stack column 12, the pair of ribs thus operate to inhibit the individual bottles 13 from bridging with an adjoining bottles. By facilitating movement of the bottles through the bridging zone 77, the reliability of the vending machine 11 is substantially enhanced. The action of the vending apparatus in general and the ribs in particular, causes the merging of the bottles to occur in such a fashion that it substantially decreases, or precludes the possibility that bridging may take place.

The pair of ribs 100 include a first rib 101 which is mounted in close proximity to the left peripheral edge 83 of the main body 80 and in substantially parallel, spaced relation to the longitudinal axis 85. The pair of ribs includes a second rib 102 which is mounted on the main body 80 of the support apparatus and is disposed in substantially parallel fixed spaced relation relative to both the right peripheral edge 84 and to the first rib 101. Each of the ribs 101 and 102 has individual side walls 103 which are mounted on the main body and are disposed in a substantially normal attitude thereto. Each of the ribs has a supporting surface 104 interconnecting the pair of side walls of each rib. Each of the ribs has a first and second end 105 and 106, respectively. As best shown in FIG. 3, the first and second ribs 102 and 103, respectively, each have a predetermined length dimension which is greater than the length dimension of the main body 80 when measured along its longitudinal axis 85. Each rib has a predetermined height dimension best visualized in FIGS. 1 and 2. The height dimension of the second rib is greater than the height dimension of the first rib to accommodate the differences in the diameters of the neck portion 20 of the bottle contacted by the second rib 102 and of the butt portion 22 of the bottle, contacted by the first rib 101.

As best shown in FIG. 1, the individual supporting surfaces 104 are adapted to engage the individual bottles 13 and are thereby operable to support the individual bottles in spaced relation to the main body. It should be noted that the individual supporting surfaces of the ribs only engage a small area of the neck and butt portions 20 and 22, respectively, thereby substantially reducing the amount of friction produced in such contact. This has the effect of facilitating movement of the bottles along the column 12 and also discourages bridging from taking place. As best illustrated in FIG. 3, the longitudinal axes 14 of the individual bottles are disposed in substantially transverse relation to the longitudinal axis of the main body as they travel along the staggered stack column.

Second Form

Figure 4:
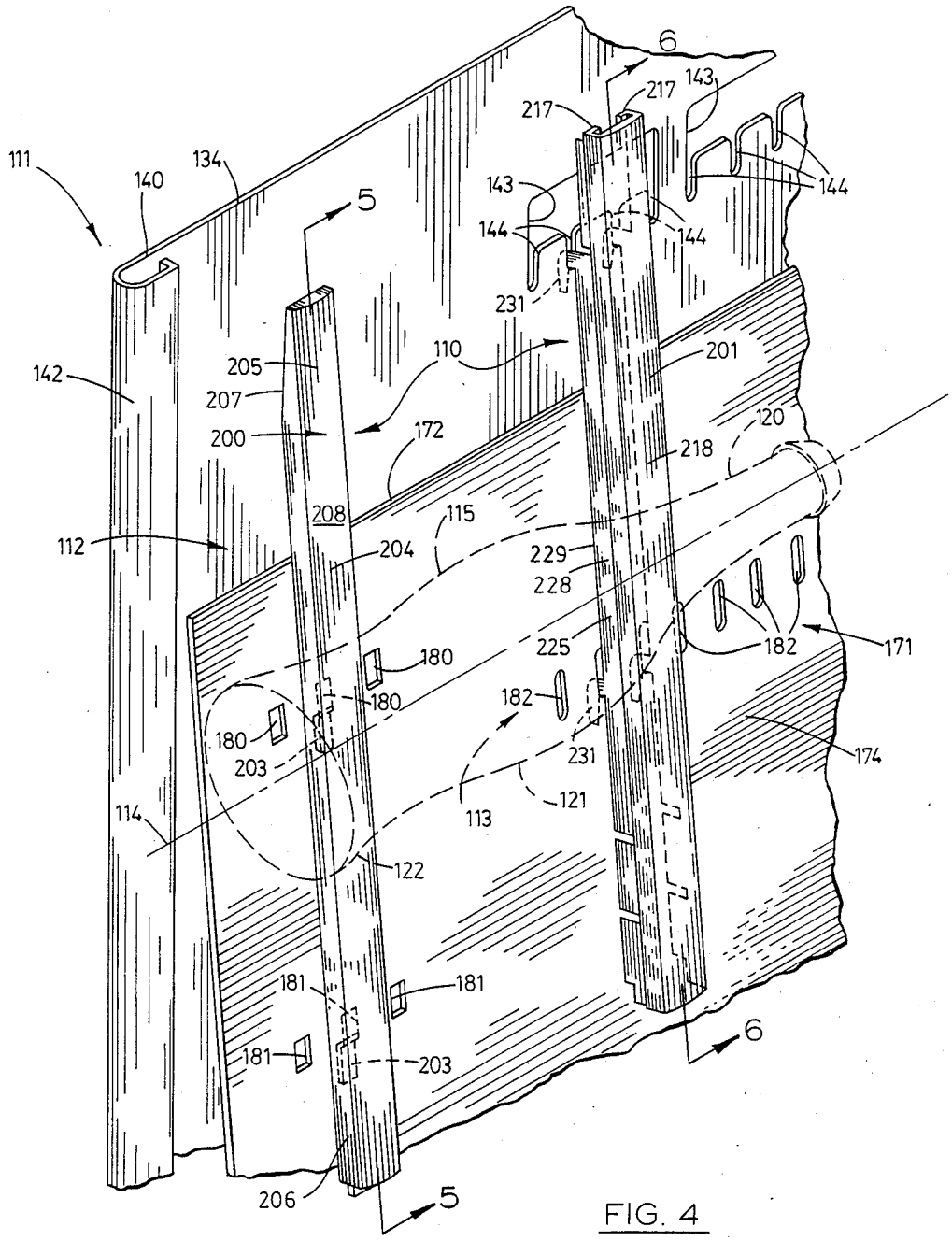
FIG. 4 is a fragmentary, perspective view showing the second embodiment of the vending apparatus of the present invention in a typical operative environment.
Figure 6:
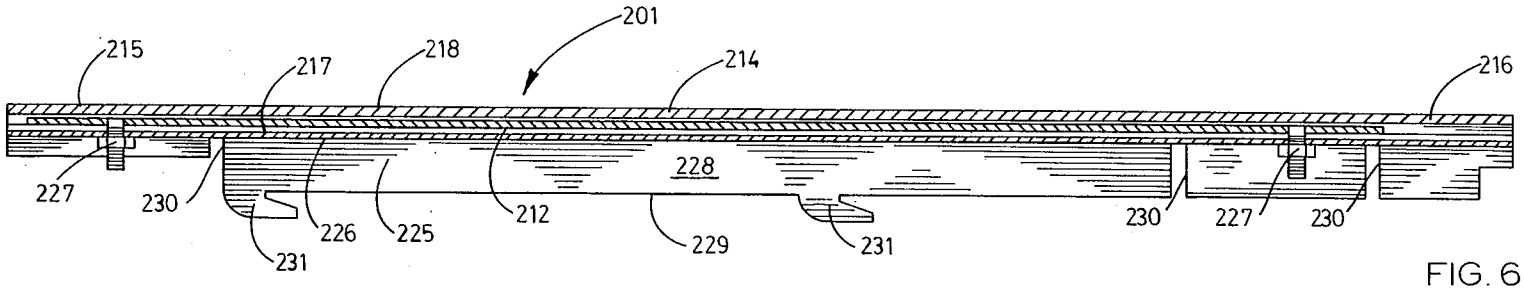
FIG. 6 is a somewhat enlarged, longitudinal section taken on line 6—6 of FIG. 4.
Figure 5:
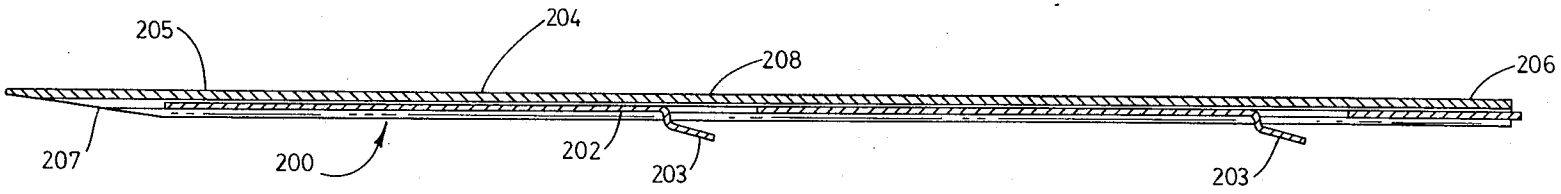
FIG. 5 is a somewhat enlarged, longitudinal section taken on line 5—5 in FIG. 4.

The second form of the vending apparatus of the present invention is shown in FIGS. 4, 5 and 6 and is generally indicated by the numeral 110. The vending apparatus 110 is distinct from the vending apparatus 10 of the first form of the present invention in a number of respects, the most noticeable being that it does not have a main body corresponding to the main body 80 of the vending apparatus 10.

As shown in FIG. 4, the vending apparatus 110 is mounted on a vending machine 111 having a staggered stack column 112 adapted to receive vendables such as bottles to the type shown in phantom lines at 113. The bottle 113 has a longitudinal axis 114 and an exterior surface 115. The exterior surface, as shown in FIG. 4, is of the traditional "coke" bottle configuration having a neck portion 120, a shoulder portion 121 and a butt portion 122.

It will be understood that the vending machine 111 is substantially identical to vending machine 11 shown fragmentarily in FIGS. 1, 2 and 3 in respect to the first form of vending apparatus 10 of the present invention. For illustrative convenience, only the first wall 134 of the vending machine is shown in FIG. 4 for purposes of exhibiting such differences as do exist. The first wall 134 has a first end 140 having a channeling surface or flange 142. The first wall has a pair of rectangularly shaped openings 143 each having a plurality of downwardly extending adjustment slots 144.

As shown in FIG. 4, the vending machine 111 has a ramp 171 mounted on the first wall 134. The ramp 171 is substantially identical to ramp 71 of vending machine 11 shown in FIGS. 1, 2 and 3. The ramp has a first end 172 and a supporting surface 174. As with ramp 71, ramp 171 is operable to cause the staggered column of bottles 113 to converge into a single column product row. The single column product row, so formed, feeds and is acted upon by a dispensing mechanism, not shown.

As distinct form the ramp 71, ramp 171 has an upper set of three rectangular slots 180, a lower set of rectangular slots 181 and a set of oval slots 182. The purpose for these sets of slots will become apparent upon further description of the second form of vending apparatus 110.

The second form of vending apparatus 110 consists of a pair of members, ridges or ribs, more particularly a first rib 200, shown on the left in FIG. 4 and in longitudinal section in FIG. 5, and a second rib 201, shown on the right in FIG. 4 and in longitudinal section in FIG. 6.

The first rib 200 has a base plate 202 preferably constructed of a deformable metal which can be bent to shape and will hold the shape so formed. The base plate has a pair of portions punched out to form a pair of hooks 203. The first rib has an outer jacket 204 which is fitted about the base plate and which is constructed preferably of a suitable plastic material having a low coefficient of friction. The outer jacket has an upper end portion 205 and an opposite lower end portion 206. The upper end portion has a beveled surface 207. The outer jacket has a supporting surface 208 running the full length thereof and thus affording the properties of the low coefficient of friction of the plastic material from which the outer jacket is constructed for the length of the first rib.

The second rib 201 has a base plate 212 about which is fitted an outer jacket 204 preferably constructed of a suitable plastic material having a low coefficient of friction. The outer jacket has an upper end portion 215 and a lower end portion 216. The outer jacket has lateral inwardly bent flanges 217 which are fitted about the lateral edges of the base plate thereby capturing the outer jacket thereon. The outer jacket has a supporting surface 218 running the full length thereof and thus affording the properties of the low coefficient of friction for the length of the second rib.

The second rib 201 has a mounting frame 225 with a spine portion 226. The spine portion is mounted on the base plate 212 with the return bent flanges 217 captured therebetween by a pair of nut and bolt assemblies 227. The mounting frame has side walls 228 which extend in spaced substantially parallel relation to each other from and substantially normal to the spine portion 226. The side walls end in terminal edges 229. Slots 230 extend from the terminal edges inwardly of the side walls to the spine portion of the mounting frame at corresponding predetermined locations to permit bending of the spine portion and base plate, and thus the second rib 201, as may be desired. Hooks 231 are provided on and extend from the terminal edges of the side walls in corresponding locations, as best shown in FIG. 6.

OPERATION

The operation of the described embodiment of the present invention is believed to be readily apparent and is briefly summarized at this point.

The vending apparatus 10 of the first form of the invention has particular utility when mounted on a staggered stack column 12 which has a ramp 71. When properly mounted, the vending apparatus is disposed in partial overlying relation to the ramp and in converging relation to the second wall 35. While the ramp itself is operable to cause the bottles 13 in the staggered stack column 12 to merge, the vending apparatus 10 causes this to be performed in such a fashion that bridging between adjacent bottles is substantially reduced or eliminated. This is particularly effective in preventing bridging in the bridging zone 77.

As best illustrated by reference to FIG. 1, first and second ribs 101 and 102, respectively, of the main body 80 individually engage the neck portion 20 and butt portion 22 of each bottle to release the shoulder portion 21 thereof from any contact with any surface during passage of the bottle therealong. It has been discovered that when the shoulder portions 21 of the bottles are positioned in spaced relation to the main body, the likelihood of bridging substantially decreases. This is also due, in part, to the fact that only a very small portion of the exterior surface 15 of each bottle is exposed to direct contact with the supporting surfaces 104 of each rib. Therefore the individual bottles gravitationally travel with less frictional resistance along the staggered stack column and into feeding relation with the dispensing mechanism, not shown.

The operation of the second form of vending apparatus 110 is closely similar to that of the first form 10. As shown in FIG. 4, the first rib 200 is attached to the ramp 171 in the desired position by extending the hooks 203 thereof individually through corresponding vertically aligned slots 180 and 181. The desired position is dependent upon the configuration of the bottle being vended through the column 112. As previously described, the first rib and more specifically the base plate 202 thereof can be bent so that the first rib conforms to the first wall 134 of the vending machine 111 and to the slope of the ramp 171.

The second rib 201 is attached in much the same manner by extension of the hooks 231 of the mounting frame 225 thereof through vertically aligned corresponding adjustment slots 144 and oval slots 182, as best shown in FIG. 4. As with the first rib 200, the second rib 201 and the base plate 212 and spine portion 226 of the mounting framed 225 thereof can be bent, as permitted by the slots 230 thereof to conform to the first wall 134 and ramp 171. Preferably the second rib is bent sufficiently to permit the terminal edges 229 of the side walls 228 to seat against the first wall 134 and the ramp 171. However, this is less important in the case of the second rib than in the case of the first rib because of the configurations of bottles passing thereover.

As shown in FIG. 4, the first rib 200 is preferably positioned so that bottles 113 passing thereover are contacted by the first rib between the shoulder portions 121 and butt portions 122 thereof. The second rib 201 is preferably positioned as shown in FIG. 4 with the neck portions 120 of the bottles passing therealong. When so positioned, the butt portions 122 and shoulder portions 121 of the bottles are relieved from contact with the first wall 134 of the vending machine 111 and from contact with the ramp 171. As a consequence, individual bottles gravitationally travel with less frictional resistance along the staggered stack column and into feeding relation with the dispensing mechanism, not shown. The plastic material from which the outer jackets 204 and 214 of the first and second ribs are constructed further ease passage of the bottles therealong.

The beveled surface 207 of the upper end portion 205 of the first rib 200 permits the upper end portion to converge upon the surface of the first wall 134 as shown in FIG. 4. The taper so formed allows the portions of the bottles between the butt portions 122 and shoulder portions 121 easily to slide thereover even though the clearance is less than with respect to the neck portions of the bottles.

Therefore it will be seen that the vending apparatus 10 of the instant invention is operable to prevent product bridging in the vending of products and particularly bottled products; to enhance the versatility of conventional vending machines by permitting them to vend bottles and other containers of assorted dimension; to provide a fully dependable and practical means by which a conventional vending machine can rapidly be retrofitted by unskilled personnel in the field so as to allow it to dispense bottles with a high degree of speed and reliability, and with the attendant benefits associated therewith; and further is of both sturdy and dependable construction and is relatively inexpensive to manufacture and maintain.

Although the invention has been herein shown and described in what are conceived to be the most practical and preferred embodiments, it is recognized that departures may be made therefrom within the scope of the invention which is not to be limited to the illustrative details disclosed.

Having described our invention, what we claim as new and desire to secure by Letters Patent is:

1. In combination with a vending machine having a staggered stack column containing a plurality of staggered containers, each container having a recess of a predetermined depth, a ramp operable to urge containers within said column into more nearly single file, vertically aligned relation within the column, a vending apparatus comprising a substantially rigid member having a predetermined operable thickness equal to or greater than said predetermine depth of the recess of each container; and means for mounting said member on the ramp in substantially fixed, nonresilient relation in substantially vertical alignment with said recesses of the containers in said column for engagement of the member with the containers within the recesses thereof to reduce resistance to passage of the containers along the ramp by releasing portions of the containers from resistant contact with the ramp.

2. The combination of claim 1 wherein each of said container has a pair of said recesses and the vending apparatus has a pair of said members and the mounting means mount said pair of members on the ramp individually in vertical alignment with the recesses of said pair of the containers in said column.

3. The combination of claim 1 wherein said mounting means include means borne by the member for releasably mounting the member on the ramp whereby members of different operable thicknesses can selectively be mounted on the ramp for adjustment of the column for the receipt of containers having recesses of different common depths.

4. The combination of claim 3 wherein said mounting means include hooks mounted on the member for extension through openings in the ramp releasably to mount the member thereon.

5. The combination of claim 1 wherein said member has an outwardly facing surface composed of a material having a lower coefficient of friction than said ramp.

* * * * *

UNITED STATES PATENT AND TRADEMARK OFFICE

CERTIFICATE OF CORRECTION

PATENT NO. : 4,986,615

DATED : January 22, 1991

INVENTOR(S) : Larry E. Hieb, Gregory A. Petrie, Daniel S. Carter

It is certified that error appears in the above-identified patent and that said Letters Patent is hereby corrected as shown below:

Column 7, Line 17

Delete "to"; Insert ---of---

Column 10, Line 33

Delete "container"; insert ---containers---

Signed and Sealed this

Nineteenth Day of May, 1992

*Attest:*

DOUGLAS B. COMER

*Attesting Officer*

*Acting Commissioner of Patents and Trademarks*